US009915096B2

(12) United States Patent
Potter

(10) Patent No.: US 9,915,096 B2
(45) Date of Patent: Mar. 13, 2018

(54) GARAGE DOOR LADDER STORAGE DEVICES AND METHODS THEREOF

(71) Applicant: Nth Tech Corporation, Churchville, NY (US)

(72) Inventor: Michael D. Potter, Churchville, NY (US)

(73) Assignee: NTH TECH CORPORATION, Churchville, NY (US)

( * ) Notice: Subject to any disclaimer, the term of this patent is extended or adjusted under 35 U.S.C. 154(b) by 0 days.

(21) Appl. No.: 14/978,675

(22) Filed: Dec. 22, 2015

(65) Prior Publication Data

US 2016/0201844 A1 Jul. 14, 2016

Related U.S. Application Data

(60) Provisional application No. 62/101,750, filed on Jan. 9, 2015.

(51) Int. Cl.

| | |
|---|---|
| ***A47F 5/08*** | (2006.01) |
| ***E06C 7/50*** | (2006.01) |
| ***A47F 5/01*** | (2006.01) |
| ***A47F 5/00*** | (2006.01) |

(52) U.S. Cl.

CPC ..... *E06C 7/505* (2013.01); *A47F 5/0006* (2013.01); *A47F 5/01* (2013.01); *A47F 5/0876* (2013.01)

(58) Field of Classification Search

CPC ..... E06C 7/505; E06C 7/14; E06C 7/146; F16M 13/02; F16B 2/248; A47F 5/0006; A47F 5/08; A47F 5/01; A47F 5/00; A47F 7/143; A47F 5/0876; A47F 5/13; A47F 7/00; A47F 7/0021; A47F 7/0035; B62H 3/12; B62H 3/02; A47G 25/06; A47G 25/0621; A47G 25/0628; A47G 25/0642

USPC ..... 211/87.01, 106.01, 106, 60.1, 18, 70.5; 248/210, 211, 301, 303, 304, 309.1, 238, 248/302, 305, 218.4, 219.1, 219.4, 227.3

See application file for complete search history.

(56) References Cited

U.S. PATENT DOCUMENTS

| | | | | | |
|---|---|---|---|---|---|
| 614,778 | A * | 11/1898 | Tompkins | A47F 5/01 | 211/106 |
| 1,575,270 | A * | 3/1926 | Jankowsky | A47F 5/00 | 211/123 |
| 1,942,726 | A * | 1/1934 | Newquist | A47F 7/148 | 211/106 |
| 2,222,831 | A * | 11/1940 | Bitney | A62C 33/04 | 211/106 |

(Continued)

*Primary Examiner* — Jennifer E. Novosad
(74) *Attorney, Agent, or Firm* — LeClairRyan, a Professional Corporation

(57) ABSTRACT

A garage door ladder storage device includes at least one base structure and at least two ladder brackets. The base structure includes a brace and a plurality of garage panel detachable mounting devices connected to the brace. The two ladder brackets are spaced apart and secured to the at least one base structure. Each of the ladder brackets includes at least one first ladder support section and at least one second ladder support section. The first ladder support section is coupled to the base structure and provides a first surface to support a ladder in a first direction. The second ladder support section extends from the first ladder support section and provides a second surface to support the ladder in a second direction.

20 Claims, 14 Drawing Sheets

(56) References Cited

U.S. PATENT DOCUMENTS 2,560,896 A * 7/1951 Rubenstein ..... A47F 5/01 211/106
2,605,906 A * 8/1952 Pontius ..... A47G 25/08 211/106
2,609,937 A * 9/1952 Rubenstein ..... A47F 7/148 211/106
2,758,724 A * 8/1956 Schneider ..... A47B 96/062 211/104
2,778,588 A * 1/1957 Bruno ..... A47L 13/512 248/112
3,158,348 A * 11/1964 Rutter ..... A47B 96/061 248/217.2
3,178,032 A * 4/1965 Patrick ..... A01K 97/10 211/70.8
3,817,394 A * 6/1974 Saiki ..... A47B 57/06 211/110
3,907,113 A * 9/1975 Kropelnitski ..... B62H 3/12 211/19
4,101,107 A * 7/1978 Antoszewski ..... F16M 11/10 248/218.4
4,106,736 A * 8/1978 Becker, III ..... A47F 5/01 211/103
4,367,819 A * 1/1983 Lewis ..... A47F 5/0876 211/106.01
4,878,586 A * 11/1989 Bancroft ..... A47F 5/0807 206/702
5,078,276 A * 1/1992 Rogge ..... B62H 3/12 211/18
5,107,996 A * 4/1992 Whittaker ..... A47G 25/1457 211/113
5,125,517 A * 6/1992 Martinell ..... B62H 3/12 211/17
5,188,325 A * 2/1993 Hilty ..... A47F 7/06 211/30
5,307,944 A * 5/1994 Reedy ..... A47B 81/005 211/106
5,332,104 A * 7/1994 Santella ..... B62H 3/12 211/18
5,388,709 A * 2/1995 Adams ..... A47B 57/46 211/106
5,842,581 A * 12/1998 Graefe ..... B62H 3/00 211/119.004
5,957,238 A * 9/1999 Curvin, II ..... E06C 7/146 182/129
6,112,909 A * 9/2000 Moseley ..... A47F 5/0807 211/30
6,196,509 B1 * 3/2001 Clemens ..... A45F 5/00 248/211
6,412,647 B1 * 7/2002 Ko ..... A47B 55/02 211/106
6,494,327 B2 * 12/2002 Huang ..... A47F 5/0892 211/107
6,679,388 B1 * 1/2004 Chiu ..... B62H 3/12 211/22
6,729,478 B1 * 5/2004 Boers ..... B62H 3/12 211/18
6,823,999 B2 * 11/2004 Heneveld, Sr. ..... A47B 46/005 211/100
6,983,853 B1 * 1/2006 Fickett ..... A47F 5/04 211/18
7,040,517 B1 * 5/2006 Swanson ..... A47G 25/10 223/85
7,669,822 B2 * 3/2010 Kluge ..... F16B 45/02 211/18
7,959,020 B2 * 6/2011 Rosen ..... D06F 79/02 211/106
8,087,521 B2 * 1/2012 Schwartzkopf ..... A47B 96/061 211/103
8,141,722 B2 * 3/2012 Heroux ..... A47G 25/1457 211/113
8,646,625 B2 * 2/2014 Wang ..... A47G 25/06 211/106.01
9,681,781 B2 * 6/2017 Hurley ..... A47F 5/0876
2003/0196974 A1 * 10/2003 Cuzzocrea ..... A47F 5/0006 211/113
2005/0109721 A1 * 5/2005 Schneider ..... A47G 25/1457 211/118
2006/0017265 A1 * 1/2006 Shinn ..... B25H 3/006 280/653
2006/0049124 A1 * 3/2006 Wang ..... A47B 43/003 211/113
2007/0114348 A1 * 5/2007 Nawrocki ..... A47F 5/0006 248/220.21
2008/0251316 A1 * 10/2008 Libert ..... E04G 5/10 182/115
2016/0201844 A1 * 7/2016 Potter ..... E06C 7/505 248/205.1

* cited by examiner

GARAGE DOOR LADDER STORAGE DEVICES AND METHODS THEREOF

This application claims the benefit of U.S. Provisional Patent Application Ser. No. 62/101,750, filed Jan. 9, 2015, which is hereby incorporated by reference in its entirety.

FIELD

This technology generally relates to garage storage systems and methods and, more particularly, to garage door ladder storage devices and methods thereof.

BACKGROUND

In addition to motor vehicles, homeowners usually use their garages to store a variety of different types of indoor and outdoor items, such as bicycles, rakes, gardening tools, a lawn mower, automotive items, lawn chairs, and one or more ladders by way of example. As a result, typically the available storage space in a garage is limited.

To address this storage space problem, a variety of systems and devices have been developed to enable homeowners to try maximize the use of the available space in their garages. Most of these storage systems and devices are either adjacent to or mounted on a garage wall and are used to store and organize a variety of different items on or adjacent the walls of the garage. Unfortunately, even with these prior storage systems and devices, many homeowners still do not have enough space in their garage to store their items, in particular ladders.

SUMMARY

A garage door ladder storage device comprising at least one base structure and at least two ladder brackets. The base structure includes a brace and a plurality of garage panel detachable mounting devices connected to the brace. The two ladder brackets are spaced apart and secured to the at least one base structure. Each of the ladder brackets includes at least one first ladder support section and at least one second ladder support section. The first ladder support section is coupled to the base structure and provides a first surface to support a ladder in a first direction. The second ladder support section extends from the first ladder support section and provides a second surface to support the ladder in a second direction.

A method for making a garage door ladder storage device includes providing at least one base structure comprising a brace and a plurality of garage panel detachable mounting devices connected to the brace. At least two ladder brackets are spaced apart and secured to the at least one base structure. Each of the ladder brackets includes at least one first ladder support section and at least one second ladder support section. The first ladder support section is coupled to the base structure and provides a first surface to support a ladder in a first direction. The second ladder support section extends from the first ladder support section and provides a second surface to support the ladder in a second direction.

This technology provides a number of advantages including providing an optimized garage door ladder storage device which is very easy to use to detachably mount and to dismount items, such as a ladder, to the back of a garage door panel. The garage door ladder storage device helps to reduce clutter, increases the amount of usable storage space in a garage, and provides secure and safe ladder storage.

DETAILED DESCRIPTION

Examples of garage door ladder storage devices 10(1)-10(8) are illustrated in FIGS. 1-9 and various other types and/or numbers of combinations of the different elements and/or configurations of the examples of the garage door ladder storage devices 10(1)-10(8) could be used. Each of the garage door ladder storage device 10(1)-10(8) includes at least one of the base structures 12(1)-12(6) and two of the ladder brackets 14(1)-14(3), although each of the garage door ladder storage devices 10(1)-10(8) could include other types and/or numbers of other devices, components, and/or other elements connected in other manners. This technology provides a number of advantages including providing an optimized garage door ladder storage device which is very easy to use to detachably mount and to dismount items, such as a ladder, to the back of a garage door panel.

Figure 1:
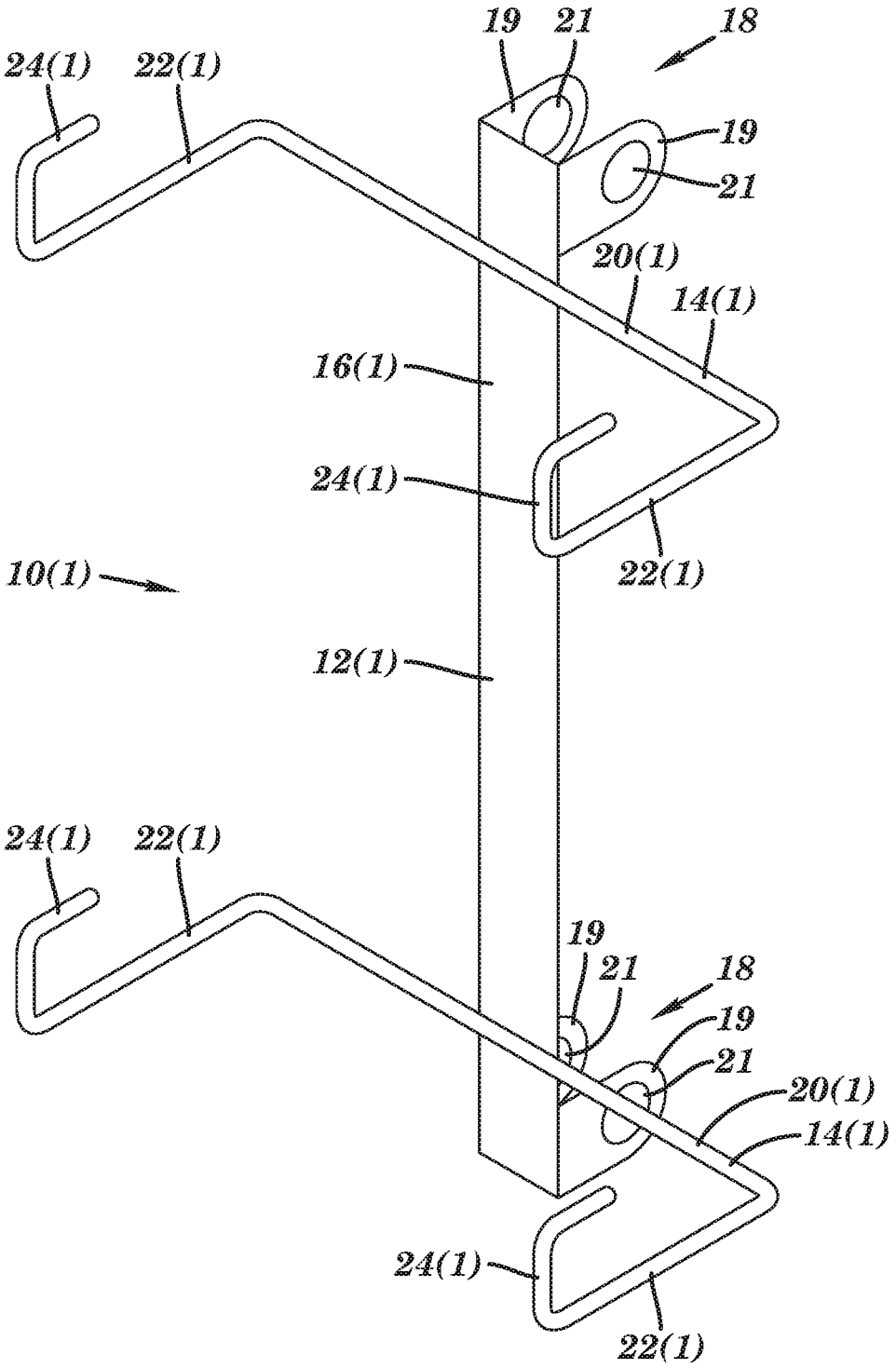
FIG. 1 is a perspective view of an example of a garage door ladder storage device.

Referring more specifically to FIG. 1, the garage door ladder storage device 10(1) includes base structure 12(1) and two ladder brackets 14(1), although the garage door ladder storage device could include other types and/or numbers of other devices, components, and/or other elements connected in other manners as illustrated by way of example only with the garage door ladder storage devices 10(2)-10(8). The base structure 12(1) includes an elongated brace 16(1) and garage panel detachable mounting devices 18, although other types of base structures with other types and/or numbers of other braces with the same or other lengths, other detachable mounting devices, and/or other elements could be used. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(1) to a garage panel by way of example only, although other types and/or numbers of detachable mounting devices to attach the base structure 12(1) to a garage panel could be used.

The two ladder brackets 14(1) are spaced apart and secured to the base structure 12(1). Each of the ladder brackets 14(1) includes a beam section 20(1), first ladder support sections 22(1) and second ladder support sections 24(1), although each of the ladder brackets could include other types and/or numbers of other devices, components, and/or other elements connected in other manners. A middle portion of the beam section 20(1) is secured to the base structure 12(1) and outer end portions of the beam section are each connected to one of the first ladder support sections 22(1). Each of the first ladder support sections 22(1) extends out from the beam section 20(1) in a first direction away from the base structure 12(1), although the first ladder support sections 22(1) could extend in other directions and/or orientations. Each of the second ladder support sections 24(1) extends out from an end of one of the first ladder support sections 22(1) with an outer end pointed in a direction towards the base section 12(1) to form a securing hook section, although the second ladder support sections 24(1) could have other configurations.

Figure 2:
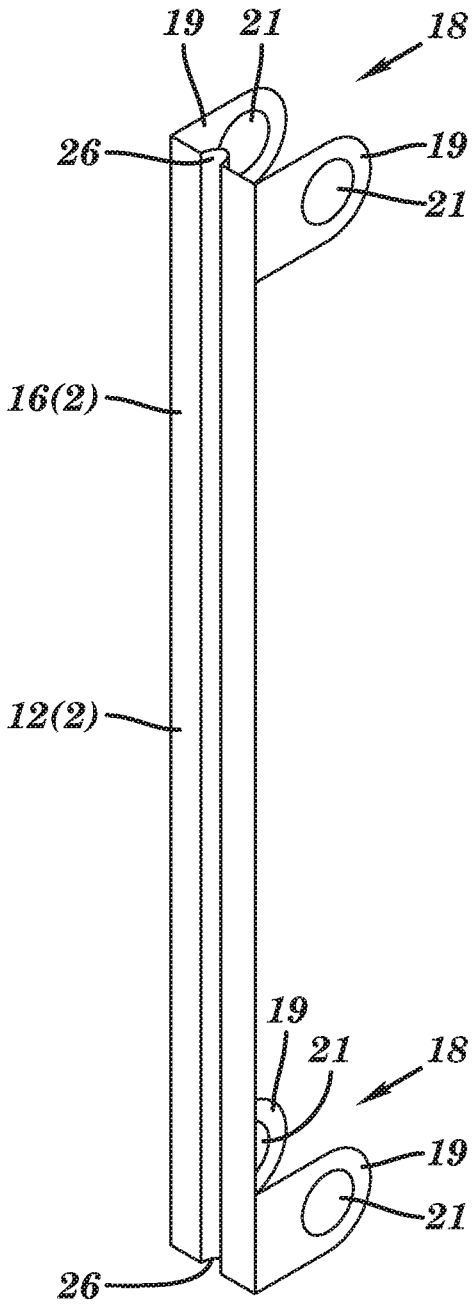
FIG. 2 is a perspective view of an example of another base structure with a crease for the garage door ladder storage device shown in FIG. 1 with a separate partial perspective view of this base structure to more clearly illustrate the crease.

Referring to FIG. 2, an example of another base structure 12(2) with an elongated brace 16(2) with a crease 26 for the garage door ladder storage device 10(1) is illustrated. The crease 26 adds structural strength to the elongated brace 16(2), although other types and/or numbers of creases or other approaches to strengthen the base structure 12(2) could be used.

Figure 3:
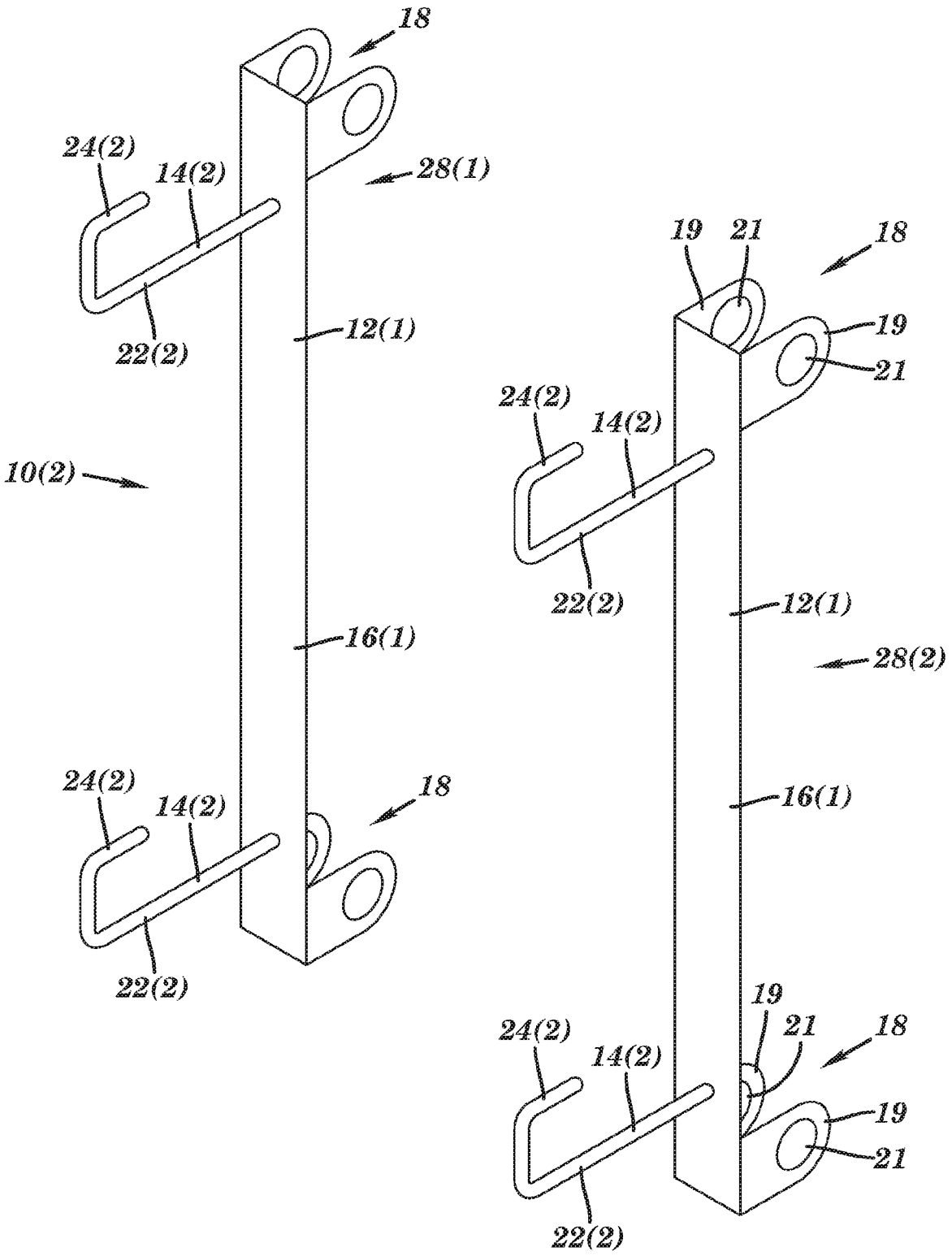
FIG. 3 is a perspective view of another example of a garage door ladder storage device with multiple units.

Referring to FIG. 3, an example of another garage door ladder storage device 10(2) comprising with multiple units 28(1)-28(2) is illustrated. Each of the units 28(1)-28(2) includes the base structure 12(1) and two ladder brackets 14(2), although each of the units could include other types and/or numbers of other devices, components, and/or other elements connected in other manners. The base structure 12(1) includes the elongated brace 16(1) and the garage panel detachable mounting devices 18. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(1) to a garage panel by way of example only, although other types and/or numbers of detachable mounting devices to attach the base structure 12(1) to a garage panel could be used.

The two ladder brackets 14(2) are spaced apart and secured to the base structure 12(1). Each of the ladder brackets 14(2) includes a first ladder support sections 22(2) and second ladder support sections 24(2), although each of the ladder brackets could include other types and/or numbers of other devices, components, and/or other elements connected in other manners. Each of the first ladder support sections 22(2) is connected to and extends out in a first direction away from the base structure 12(1), although the first ladder support sections 22(2) could extend in other directions and/or orientations. Each of the second ladder support sections 24(2) extends out from an end of one of the first ladder support sections 22(2) with an outer end pointed in a direction towards the base section 12(1) to form a securing hook section, although the second ladder support sections 24(2) could have other configurations.

Figure 4:
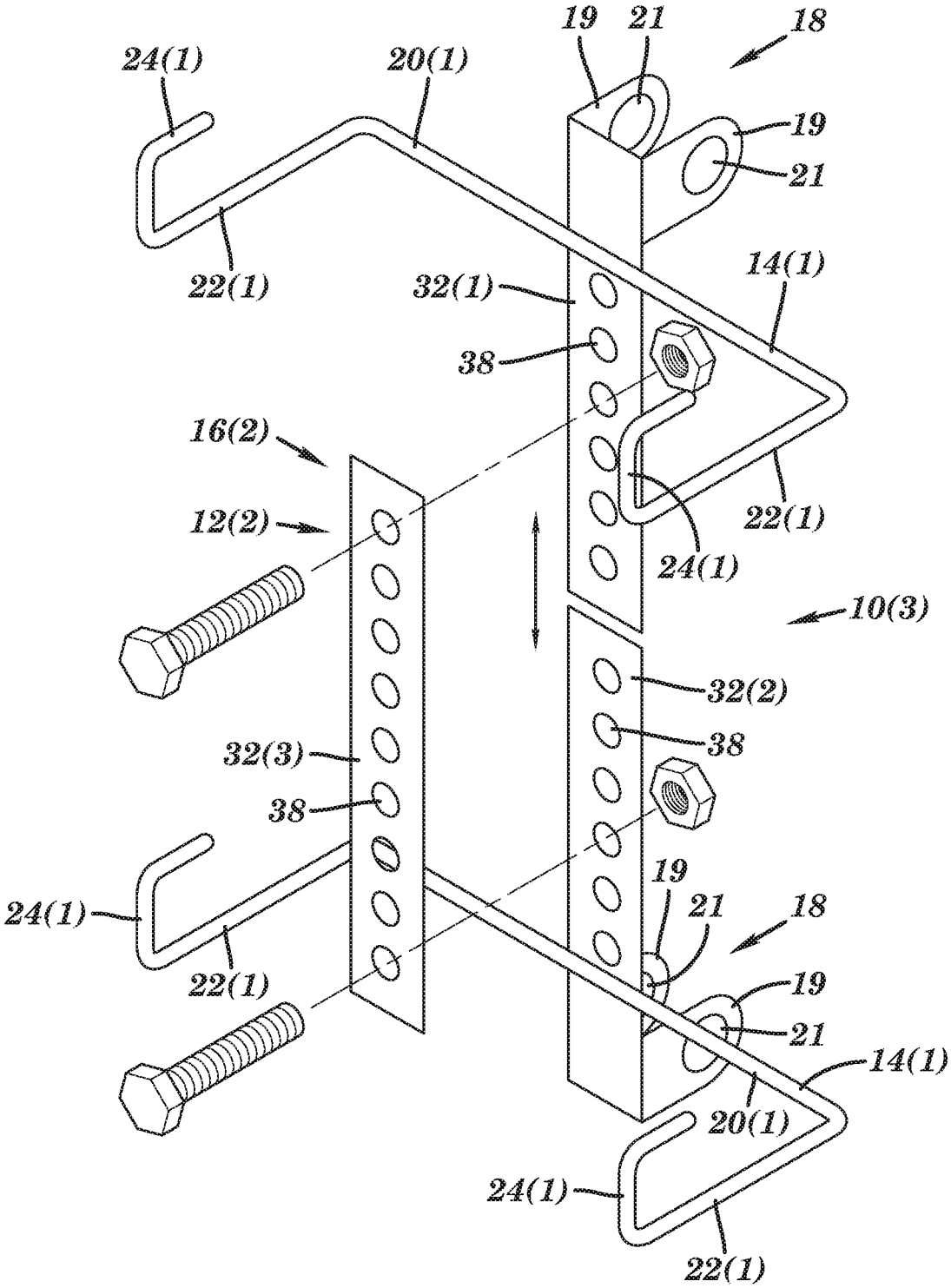
FIG. 4 is a perspective view of another example of a garage door ladder storage device with an example of an adjustable base structure.

Referring to FIG. 4, an example of another garage door ladder storage ladder brackets 14(1) is illustrated, although the garage door ladder storage device could include other types and/or numbers of other devices, components, and/or other elements connected in other manners. The base structure 12(2) includes an elongated brace 16(2) with a first brace portion 32(1), a second brace portion 32(2) and a connecting brace portion 32(3), although the brace portion may have other types and/or numbers of other devices, components and/or other elements in other configurations. One of the ladder brackets 14(1) secured to the first brace portion 32(1) and another one of the ladder brackets 14(1) is secured to the second brace portion 32(2). The connecting brace portion 32(3) is detachably and adjustably connected, such as by a nut and bolt through aligned openings in the portions 32(1)-32(3) by way of example only, to the first brace portion 32(1) adjacent one end and the second brace portion 32(2) adjacent the other end. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(2) to a garage panel by way of example only, although other types and/or numbers of detachable mounting devices to attach the base structure 12(1) to a garage panel could be used.

Each of the ladder brackets 14(1) includes a beam section 20(1), first ladder support sections 22(1) and second ladder support sections 24(1), although each of the ladder brackets could include other types and/or numbers of other devices, components, and/or other elements connected in other manners. A middle portion of the beam section 20(1) is secured to the portions 32(1) and 32(2) of the base structure 12(2) and outer end portions of the beam section 20(1) are each connected to one of the first ladder support sections 22(1). Each of the first ladder support sections 22(1) extends out from the beam section 20(1) in a first direction away from the base structure 12(2), although the first ladder support sections 22(1) could extend in directions and/or other orientations. Each of the second ladder support sections 24(1) extends out from an end of one of the first ladder support sections 22(1) with an outer end pointed in a direction towards the base section 12(2) to form a securing hook section, although the second ladder support sections 24(1) could have other configurations.

Figure 5:
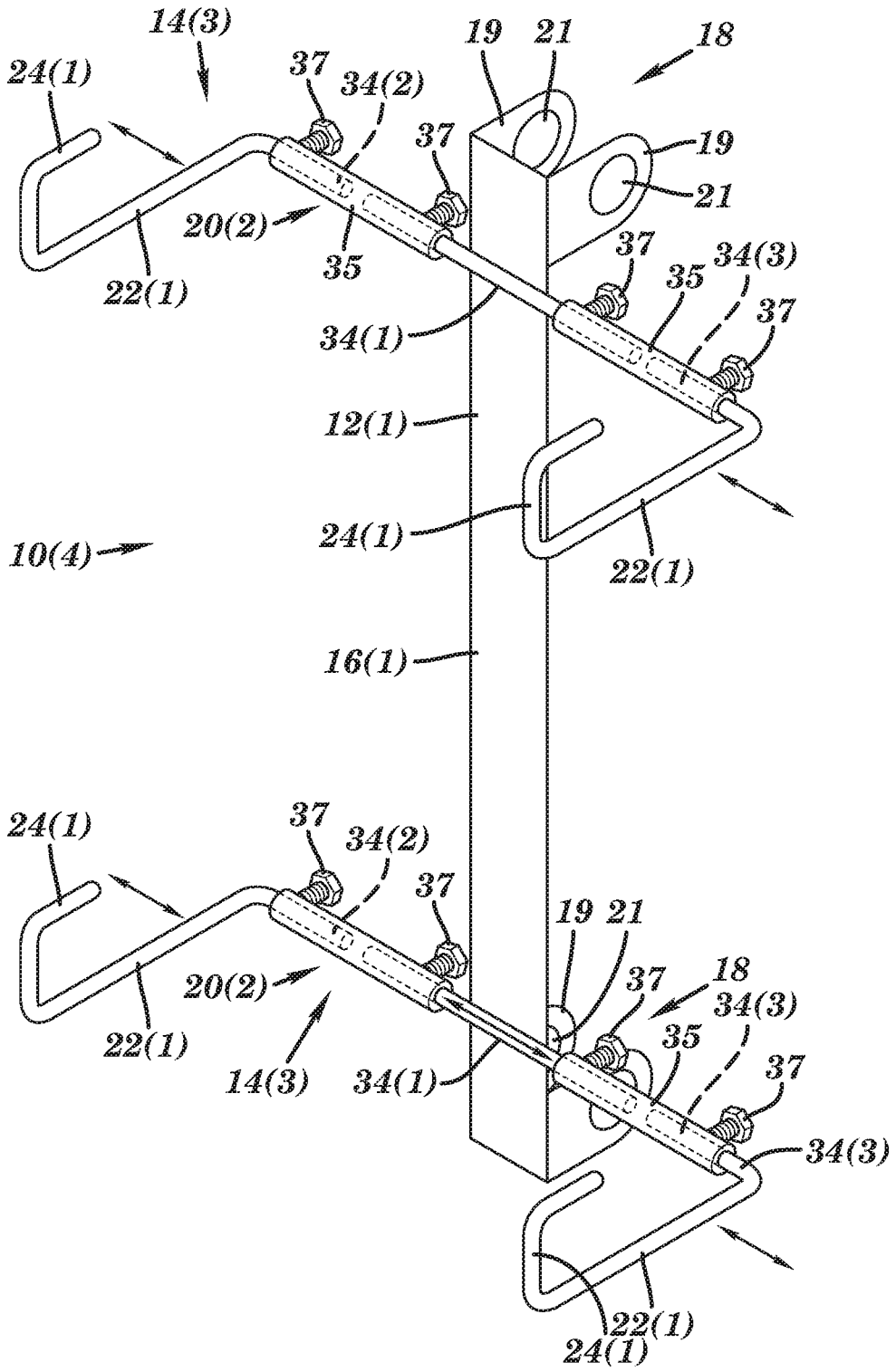
FIG. 5 is a perspective view of another example of a garage door ladder storage device with an example of adjustable length ladder brackets.

Referring to FIG. 5, an example of another garage door ladder storage device 10(4) with a base structure 12(1) and adjustable length ladder brackets 14(3) is illustrated, although the garage door ladder storage device could include other types and/or numbers of other devices, components, and/or other elements connected in other manners. The base structure 12(1) includes an elongated brace 16(1) and garage panel detachable mounting devices 18. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(1) to a garage panel by way of example only, although other types and/or numbers of detachable mounting devices to attach the base structure 12(1) to a garage panel could be used.

The two ladder brackets 14(3) are spaced apart and secured to the base structure 12(1). Each of the ladder brackets 14(3) includes a beam section 20(2), first ladder support sections 22(1) and second ladder support sections 24(1), although each of the ladder brackets could include other types and/or numbers of other devices, components, and/or other elements connected in other manners. Each of the beam sections 20(2) includes a central beam portion 34(1), a first beam portion 34(2), a second beam portion 34(3), and tubes 35, although each of the beam sections could comprise other types and/or numbers of other device, components, and/or elements in other configurations. Each of the central beam portions 34(1) is secured to the base structure 12(1). Each of the first beam portions 34(2) is connected to one of the first ladder support sections 22(1) and each of the second beam portions 34(3) is connected to another one of the first ladder support sections 22(1). One end of one of the first beam portion 34(2) and one end of one of the central beam portions 34(1) are slidably mounted in opposing ends of one of the tubes 35 and can be detachably secured in place with screw clamps 37. Additionally, one end of one of the second beam portion 34(3) and another end of one of the central beam portions 34(1) are slidably mounted in opposing ends of another one of the tubes 35 and can be detachably secured in place by tightening screw clamps 37.

Each of the first ladder support sections 22(1) extends out from the beam section 20(1) in a first direction away from the base structure 12(1), although the first ladder support sections 22(1) could extend in other directions and/or orientations. Each of the second ladder support sections 24(1) extends out from an end of one of the first ladder support sections 22(1) with an outer end pointed in a direction towards the base section 12(1) to form a securing hook section, although the second ladder support sections 24(1) could have other configurations.

Figure 6:
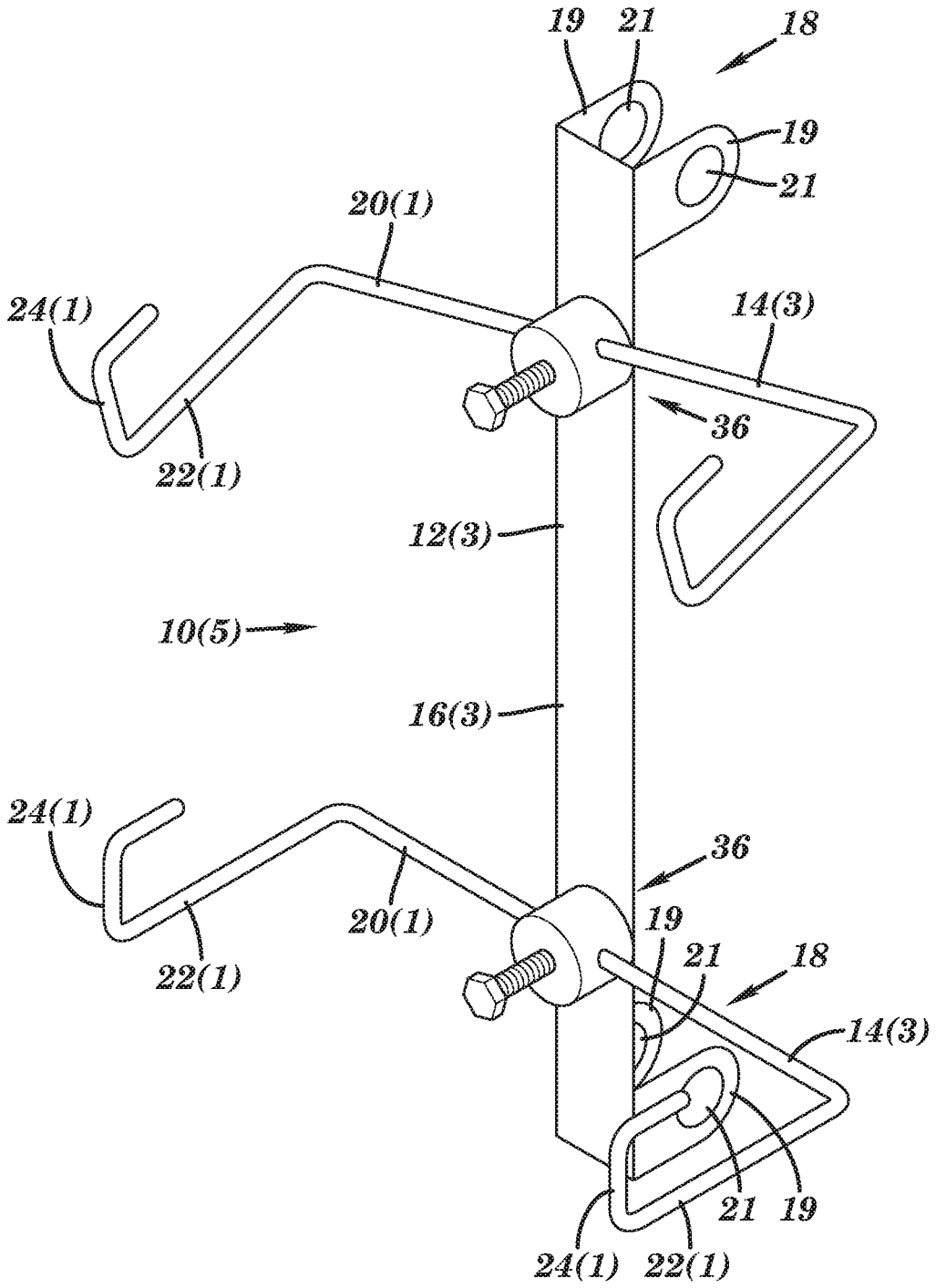
FIG. 6 is a perspective view of another example of a garage door ladder storage device with an example of slant adjustable ladder brackets.

Referring to FIG. 6, an example of another garage door ladder storage device 10(5) with a base structure 12(3) and slant adjustable ladder brackets 14(3) is illustrated, although the garage door ladder storage device could include other types and/or numbers of other devices, components, and/or other elements connected in other manners. The base structure 12(3) includes an elongated brace 16(3) and garage panel detachable mounting devices 18. In this example, the elongated brace 16(3) includes a pair of pivotal slant connection devices 36 with each of the ladder brackets 14(3) to enable a slant adjustment to accommodate storage of ladders which have a tapered width from bottom to a top of the ladder, although other approaches for providing a slant adjustment could be used. Additionally in this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(3) to a garage panel by way of example only, although other types and/or numbers of detachable mounting devices to attach the base structure 12(3) to a garage panel could be used.

The two ladder brackets 14(3) are spaced apart and pivotally secured for slant adjustment to the base structure 12(3) by the pair of pivotal slant connection devices 36. Each of the ladder brackets 14(3) includes a beam section 20(1), first ladder support sections 22(1) and second ladder support sections 24(1), although each of the ladder brackets could include other types and/or numbers of other devices, components, and/or other elements connected in other manners. A middle portion of the beam section 20(1) is pivotally secured to the base structure 12(3) by the pair of pivotal slant connection devices 36 and outer end portions of the beam section 20(1) are each connected to one of the first ladder support sections 22(1). Each of the first ladder support sections 22(1) extends out from the beam section 20(1) in a first direction away from the base structure 12(3), although the first ladder support sections 22(1) could extend in other directions and/or orientations. Each of the second ladder support sections 24(1) extends out from an end of one of the first ladder support sections 22(1) with an outer end pointed in a direction towards the base section 12(3) to form a securing hook section, although the second ladder support sections 24(1) could have other configurations.

Figure 7:
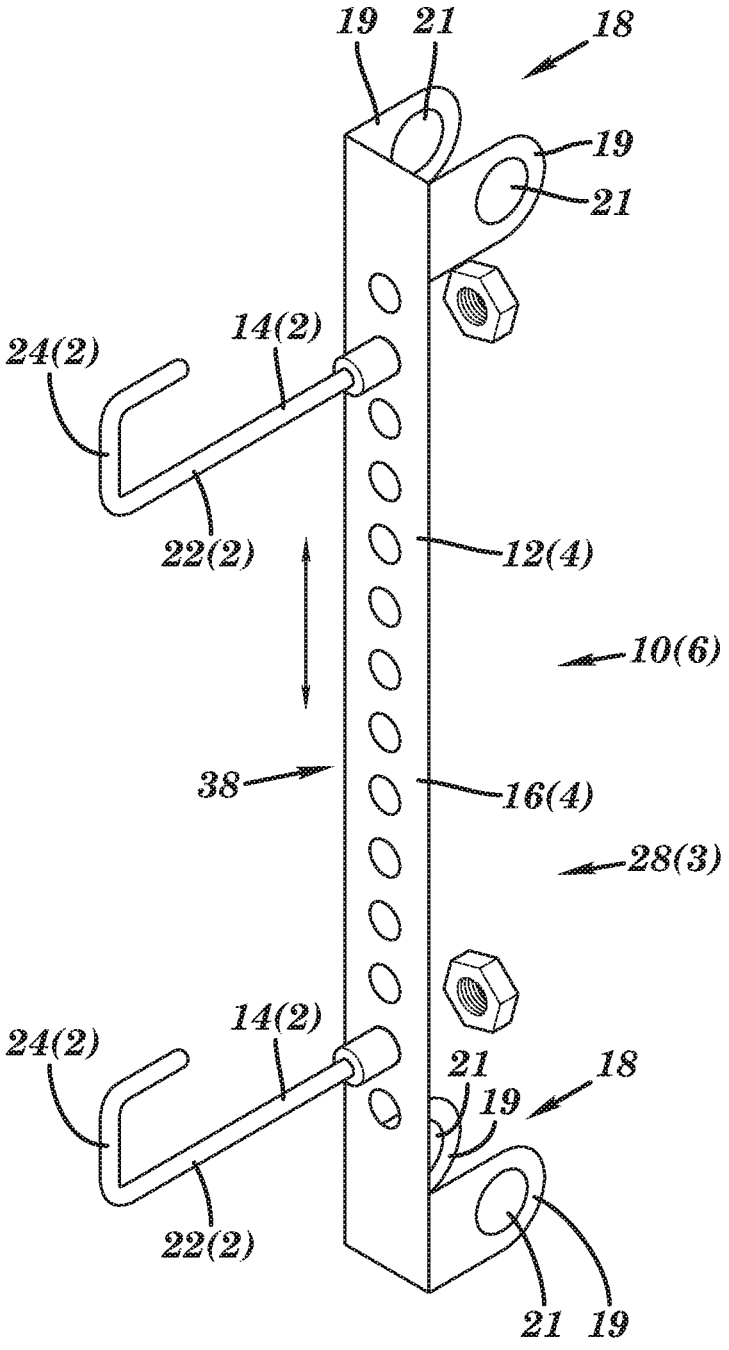
FIG. 7 is a perspective view of another example garage door ladder storage device with multiple units and adjustable ladder brackets.

Referring to FIG. 7, an example of one of multiple units 28(3) of another garage door ladder storage device 10(6) with a base structure 12(4) and adjustable ladder brackets 14(2) is illustrated, although the garage door ladder storage device could include other types and/or numbers of other devices, components, and/or other elements connected in other manners. The units 28(3) includes the base structure 12(4) and two ladder brackets 14(2), although the unit could include other types and/or numbers of other devices, components, and/or other elements connected in other manners. The base structure 12(4) includes the elongated brace 16(4) with a plurality of openings 38 to adjustably and detachably receive and secure the two ladder brackets 14(2) at different spacings with a securing device, such as a nut threaded on to the end of each ladder bracket 14(2) and the garage panel detachable mounting devices 18 by way of example only and other securing mechanisms could be used. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(4) to a garage panel by way of example only, although other types and/or numbers of detachable mounting devices to attach the base structure 12(4) to a garage panel could be used.

The two ladder brackets 14(2) are spaced apart and adjustably and detachably secured in two of the openings 38 in the elongated brace 16(4) of the base structure 12(4). Each of the ladder brackets 14(2) includes a first ladder support sections 22(2) and second ladder support sections 24(2), although each of the ladder brackets could include other types and/or numbers of other devices, components, and/or other elements connected in other manners. Each of the first ladder support sections 22(2) is adjustably and detachably secured in two of the openings 38 in the elongated brace 16(4) of the base structure 12(4) and extends out in a first direction away from the base structure 12(4), although the first ladder support sections 22(2) could extend in other directions and/or orientations. Each of the second ladder support sections 24(2) extends out from an end of one of the first ladder support sections 22(2) with an outer end pointed in a direction towards the base section 12(4) to form a securing hook section, although the second ladder support sections 24(2) could have other configurations.

Figure 8:
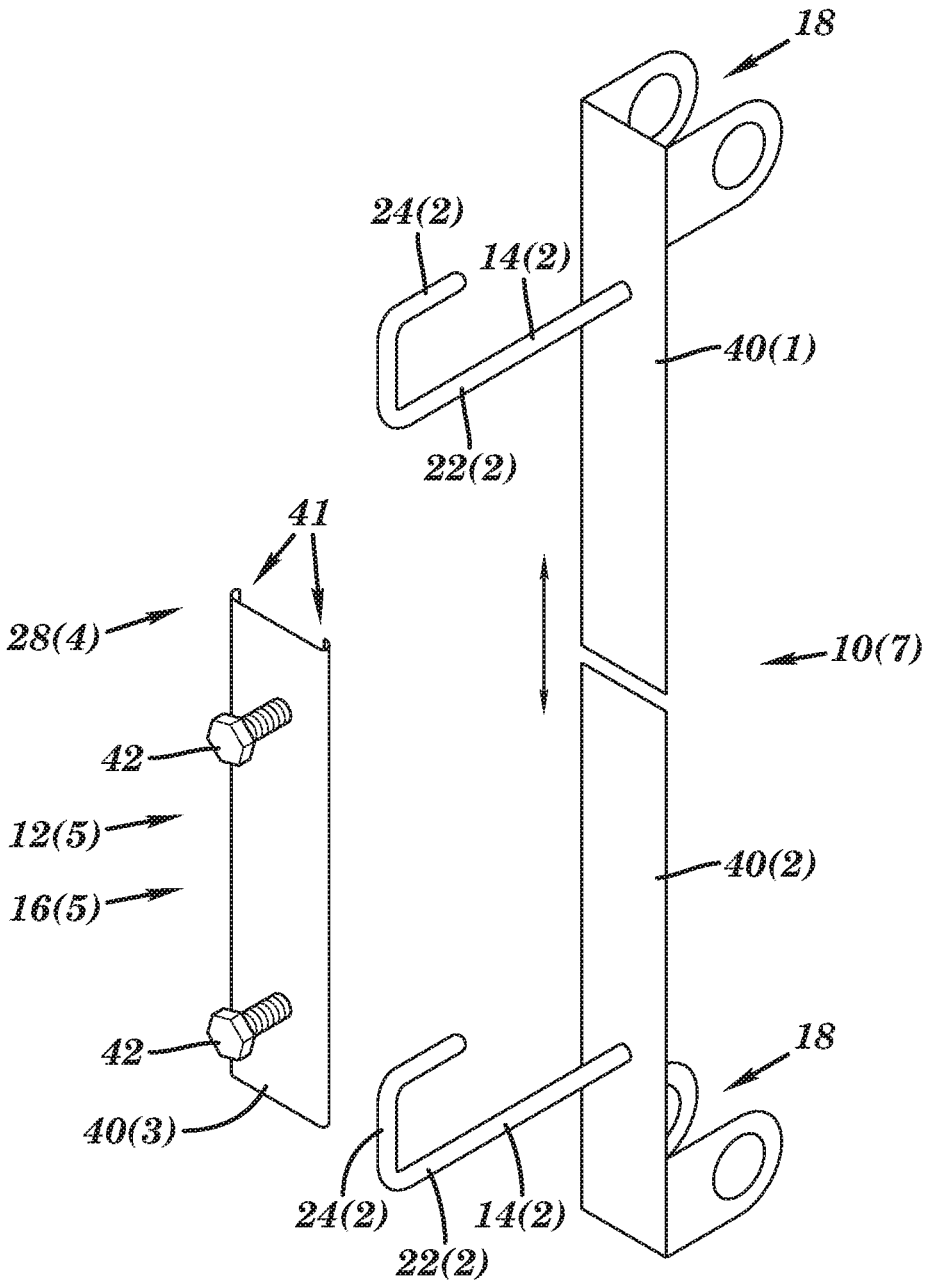
FIG. 8 is a perspective view of another example of one of multiple units of another garage door ladder storage device with an example of another adjustable base structure.

Referring to FIG. 8, an example of one of multiple units 28(4) of another garage door ladder storage device 10(7) with a base structure 12(5) and adjustable ladder brackets 14(2) is illustrated, although the garage door ladder storage device could include other types and/or numbers of other devices, components, and/or other elements connected in other manners. The base structure 12(5) includes an elongated brace 16(5) with a first brace portion 40(1), a second brace portion 40(2) and a connecting brace portion 40(3), although the brace portion may have other types and/or numbers of other devices, components and/or other elements in other configurations. One of the ladder brackets 14(2) secured to the first brace portion 40(1) and another one of the ladder brackets 14(2) is secured to the second brace portion 40(2). The connecting brace portion 40(3) has opposing elongated side lips 41 and is configured to slidably mount at one end over part of the first brace portion 40(1) and at an opposing end over a part of the second brace portion 40(2) and can be detachably secured in place by tightening screw clamps 42. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(5) to a garage panel by way of example only, although other types and/or numbers of detachable mounting devices to attach the base structure 12(5) to a garage panel could be used.

Each of the ladder brackets 14(2) includes an first ladder support section 22(2) and second ladder support section 24(2), although each of the ladder brackets could include other types and/or numbers of other devices, components, and/or other elements connected in other manners. Each of the first ladder support sections 22(2) is secured to one of the base structures 40(1) and 40(2) in the elongated brace 16(5) of the base structure 12(5) and extends out in a first direction away from the base structure 12(5), although each of the first ladder support sections 22(2) could extend in other directions and/or orientations. Each of the second ladder support sections 24(2) extends out from an end of one of the first ladder support sections 22(2) with an outer end pointed in a direction towards the base section 12(5) to form a securing hook section, although each of the second ladder support sections 24(2) could have other configurations.

Figure 9:
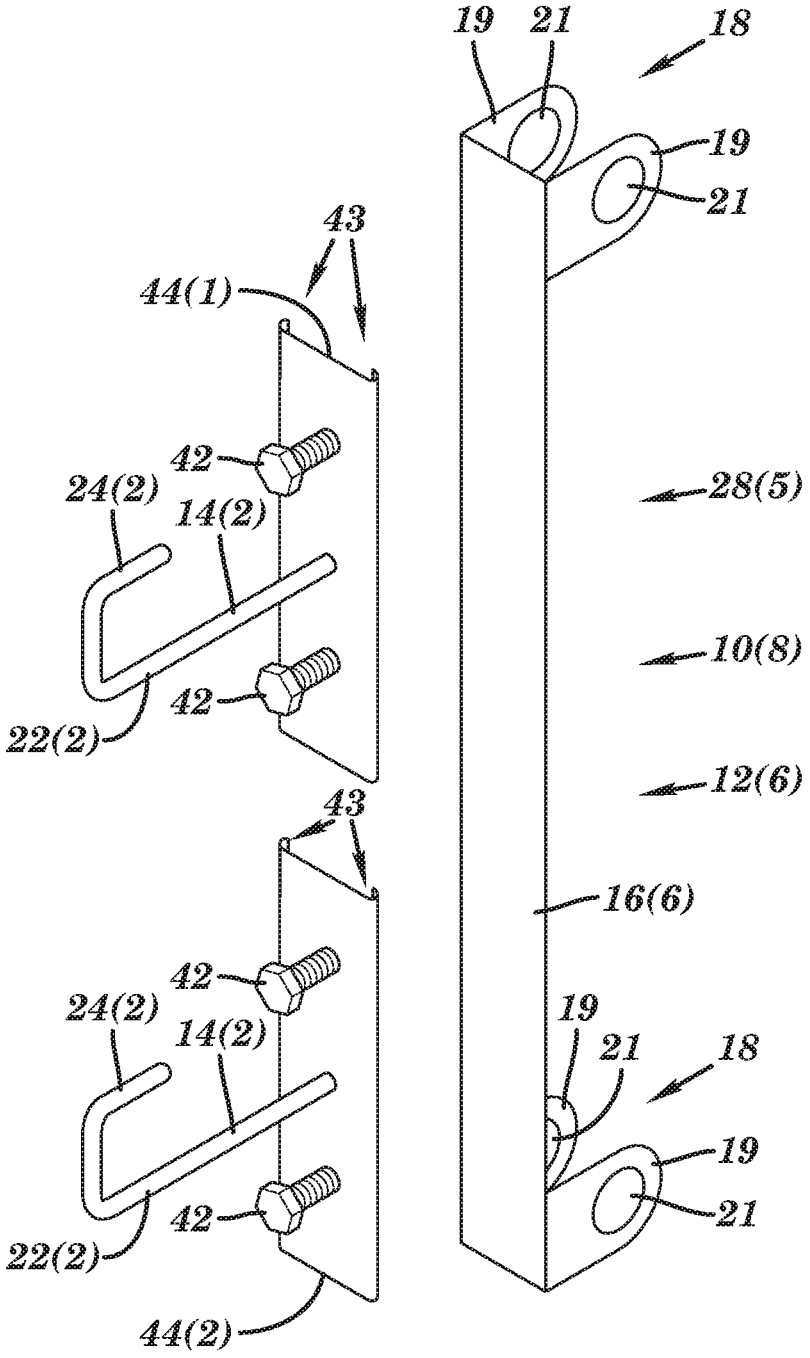
FIG. 9 is a perspective and exploded view of another example of one of multiple units of another garage door ladder storage device with an example of yet another adjustable base structure.

Referring to FIG. 9, an example of one of multiple units 28(5) of another garage door ladder storage device 10(8) with a base structure 12(6) and adjustable ladder brackets 14(2) is illustrated, although the garage door ladder storage device could include other types and/or numbers of other devices, components, and/or other elements connected in other manners. The base structure 12(6) includes an elongated brace 16(6) with a first additional brace section 44(1) and a second additional brace section 44(2), although the base structure may have other types and/or numbers of other devices, components and/or other elements in other configurations. One of the ladder brackets 14(2) is secured to the first additional brace section 44(1) and another one of the ladder brackets 14(2) is secured to the second additional brace section 44(2). The first additional brace section 44(1) and the second additional brace section 44(2) each have opposing elongated side lips 43 and are configured to slidably mount on the elongated brace 16(6) and can be detachably secured in place by tightening screw clamps 42. In this example, each of the garage panel detachable mounting devices 18 comprise wings 19 each with an opening 21, although other types and/or numbers of mounting devices could be used. The openings 21 are configured or sized to receive or mate with a securing device, such as a bolt, that passes into the opening 21 in one wing 19, passes through roll pin openings in a hinge for the garage door panel, and out another opening 21 in another wing 19 to secure with a mating nut the base structure 12(6) to a garage panel by way of example only, although other types and/or numbers of detachable mounting devices to attach the base structure 12(6) to a garage panel could be used.

The two ladder brackets 14(2) are spaced apart and secured respectively to the first additional brace section 44(1) and the second additional brace section 44(2). Each of the ladder brackets 14(2) includes a first ladder support sections 22(2) and second ladder support sections 24(2), although each of the ladder brackets could include other types and/or numbers of other devices, components, and/or other elements connected in other manners. Each of the first ladder support sections 22(2) extends out in a first direction away from the first additional brace section 44(1) and the second additional brace section 44(2), although the first ladder support sections 22(2) could extend in other directions and/or orientations. Each of the second ladder support sections 24(2) extends out from an end of one of the first ladder support sections 22(2) with an outer end pointed in a direction towards the base section 12(6) to form a securing hook section, although the second ladder support sections 24(2) could have other configurations.

An example of a method for using the garage door ladder storage device 10(1) shown in FIG. 1 will now be illustrated and described with reference to FIGS. 10-14, although the garage door ladder storage device 10(1) can be utilized in other manners. The method for using each of the garage door ladder storage devices 10(2)-10(8) is the same as for the garage door ladder storage device 10(1), except as illustrated and described herein.

Figure 10:
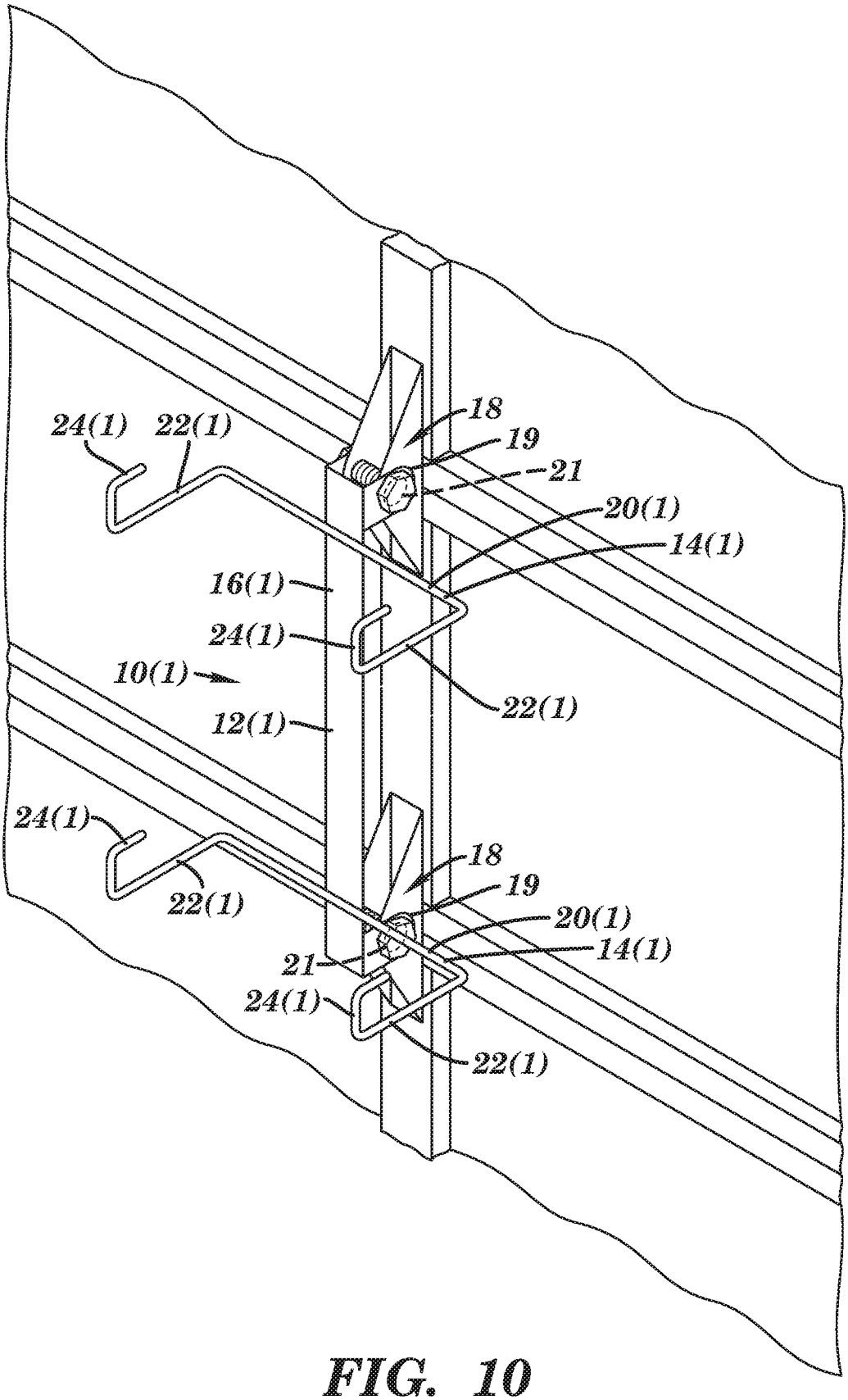
FIGS. 10-14 are perspective images of a method for using the example of the garage door ladder storage device shown in FIG. 1.

Referring more specifically to FIG. 10, initially the base structure 12(1) of the garage door ladder storage device 10(1) is secured to a panel of a garage door which is currently in a closed position. In this example, a bolt or other securing device may pass into the opening 21 in one wing 19, passes through roll pin openings in a hinge for the garage door panel, and out another opening 21 in another wing 19 and then may be secured with a mating to connect the base structure 12(1) to a garage panel by way of example only, although manners for attaching the base structure 12(1) to a garage panel could be used.

Figure 11:
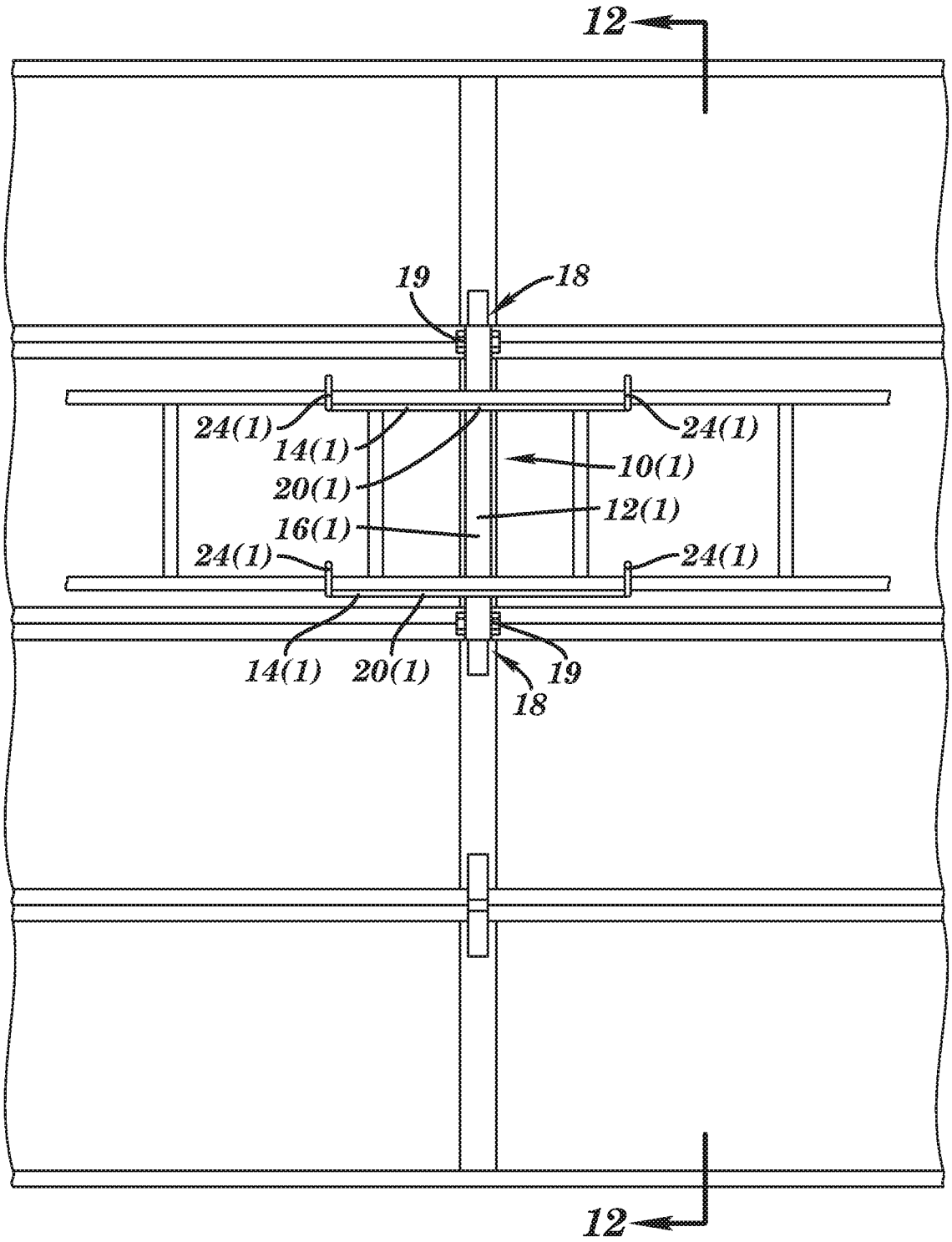
Figure 12:
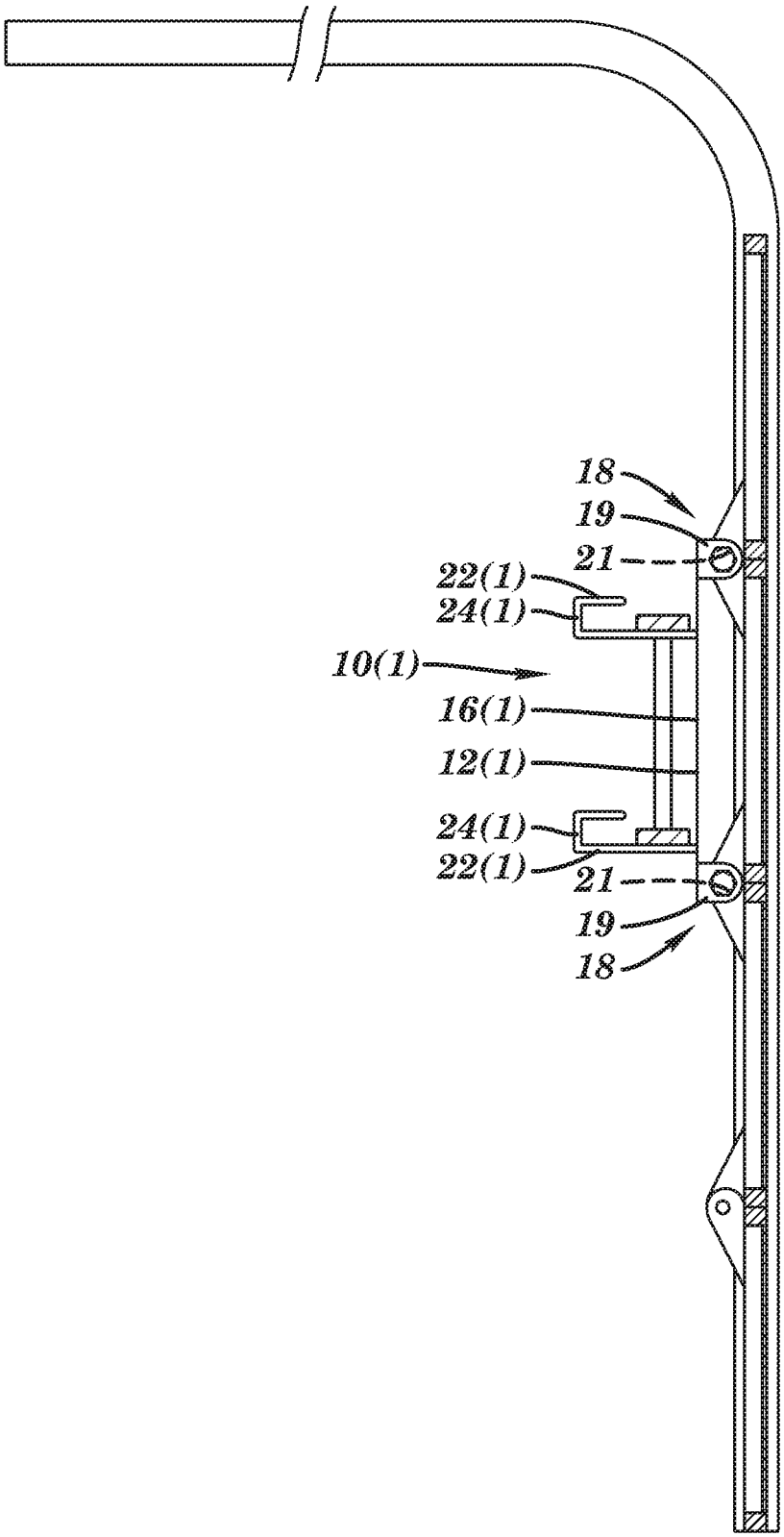

Next as shown in FIGS. 11 and 12, when the garage door is in a closed position a ladder may placed on and rest on a first surface of the first ladder support sections 22(1) of the ladder brackets 14(1) for support in a first direction, although the ladder may be supported off of the ground and on the garage door in other manners, such as by way of the other examples illustrated and described herein. Additionally, in this initial supported position the ladder is further secured from accidentally slipping off the first ladder support sections 22(1) of the ladder brackets 14(1) by the second ladder support sections 24(1) which in this example each provide a securing hook section.

Figure 13:
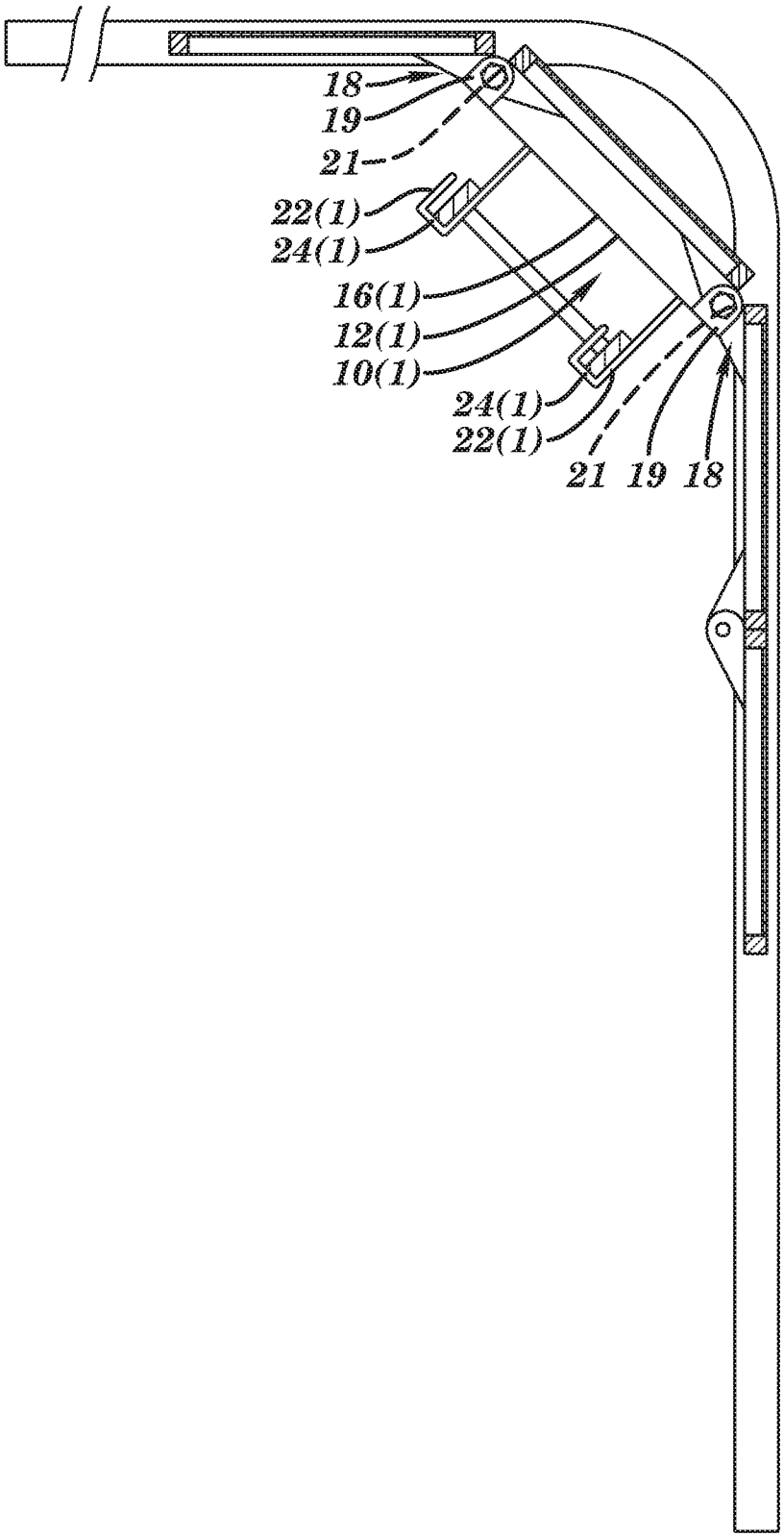
Figure 14:
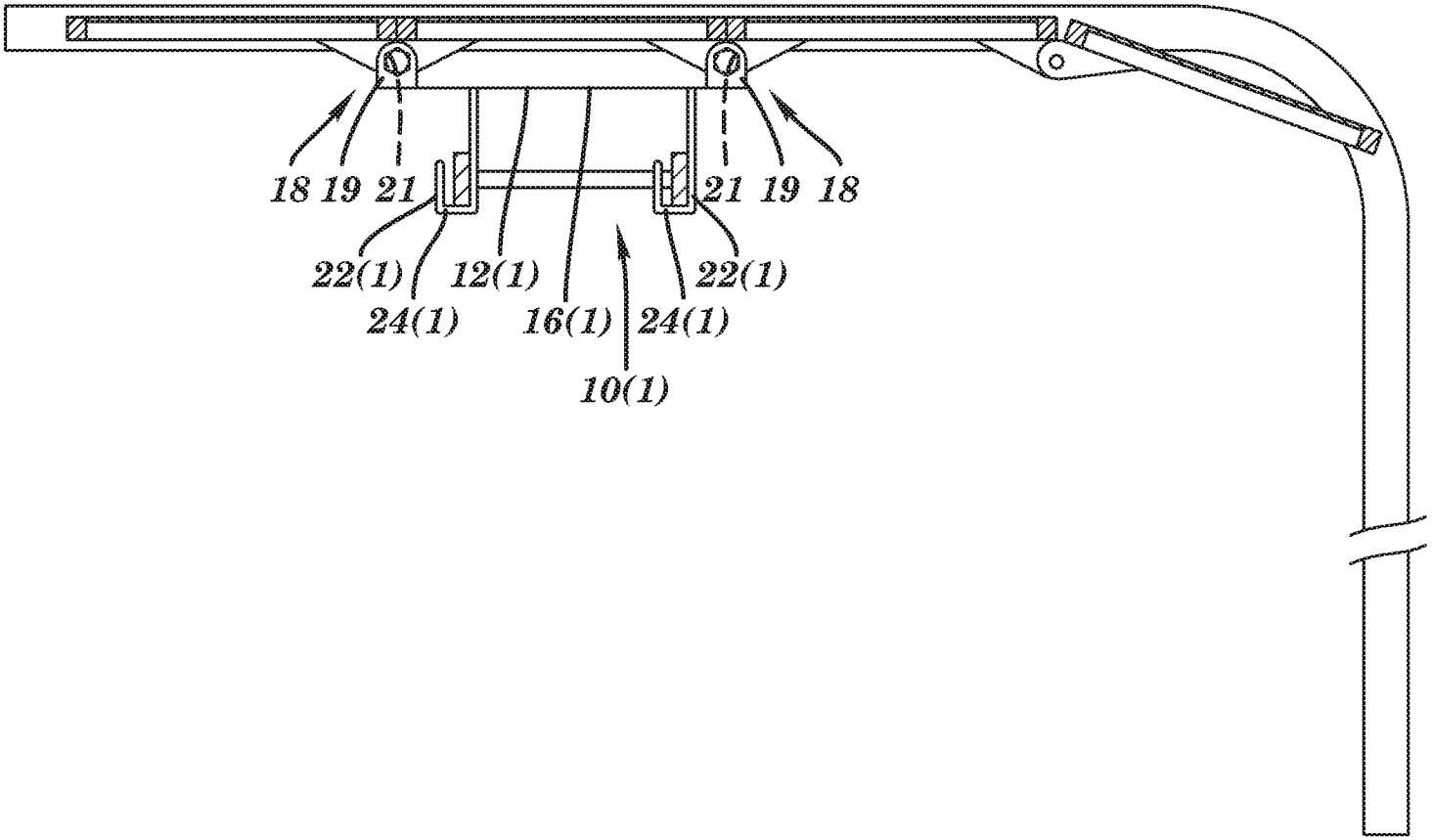

Next as shown in FIGS. 13-14 as the garage door moves to an open position, the ladder securely remains on the ladder brackets 14(1) transitioning from primarily on the first surface of the first ladder support sections 22(1) to primarily on the second surface of the second ladder support sections 24(1) to be supported in a second direction, although other manners of supporting and securing the ladder in the other directions may be used, such as illustrated and described by way of the examples herein. In this position, the ladder is securely attached to the garage door throughout the movement of the garage door between closed and open positions. To remove the ladder, the steps above may simply reversed and the ladder can be easily removed from the secure location on the garage door for use.

The operation of the garage door ladder storage devices 10(2)-10(8) is the same as the garage door ladder storage device 10(1), except as illustrated and described herein. As shown in FIG. 2, the optional crease 26 provides additional rigidity and strength to the base structure 16(2). As shown in FIG. 3, the garage door ladder storage device 10(2) may comprise two or more separate units 28(1) and 28(2) which are each spaced apart and connected to the same panel of a garage door with the ladder brackets 14(2) operating in the same manner. As shown in FIGS. 4 and 7-9, the base structures 12(2) and 12(4)-12(6) of the garage door ladder storage devices 10(3) and 10(6)-10(8) are each adjustable to accommodate ladders of different widths. As shown in FIG. 5, a width of the ladder brackets 14(3) in the garage door ladder storage device 10(4) can be adjusted to accommodate different sizes of ladders. As shown in FIG. 6, a slant of the ladder brackets 14(3) in the garage door ladder storage device 10(5) can be adjusted to accommodate ladders which taper from the bottom towards the top which taper from the bottom towards the top.

Accordingly, this technology provides garage door ladder storage devices which are very easy to use to detachably mount and to dismount a ladder to the back of a garage door. With this technology, ladders may be safely and securely stored and the amount of usable storage space in a garage is increased.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A garage door ladder storage device comprising:

at least one base structure comprising a brace and a plurality of detachable mounting devices connected to the brace and that detachably mount the base structure to a garage door that is positionable between a vertical orientation and a horizontal orientation; and at least two brackets spaced apart and secured to the at least one base structure, each of the brackets comprising:

at least one first support section coupled to the base structure and at least one second support section that extends from the first support section to form a hook-shaped section that defines a structure that provides a first contact surface on the first support section that directly engages with and supports sidepieces of a ladder off a ground surface when the device is positioned in the vertical orientation with respect to the ground surface by the garage door and provides a second contact surface on the second support section that directly engages with and supports the sidepieces of the ladder off the ground surface when the device is positioned in the horizontal orientation respect to the ground surface by the garage door.

2. The device as set forth in claim 1 wherein at least one of the plurality of detachable mounting devices further comprises wing portions extending out on opposing sides of the base structure away from the base structure, each of the wing portions further comprising at least one opening sized to mate with a securing device.

3. The device as set forth in claim 1 wherein the brace further comprises at least one crease extending along at least a portion of a length of the brace.

4. The device as set forth in claim 1 further comprising two or more of the at least one base structures, each of the two or more of the at least one base structures having the at least two spaced apart ladder brackets.

5. The device as set forth in claim 1 wherein the brace further comprises:

a first brace portion with one of the ladder brackets secured to the first brace portion;

a second brace portion with another one of the ladder brackets secured to the second brace portion; and a connecting brace portion detachably and adjustably connected to the first brace portion and the second brace portion.

6. The device as set forth in claim 1 wherein each of the brackets further comprises:

a beam section connected to the base structure;

at least two of the first support sections which are spaced apart along and connected to the beam section; and at least two of the second support sections, each of the second support sections is connected to one of the first support sections.

7. The device as set forth in claim 6 wherein the beam section further comprises:

a central beam portion secured to the base structure;

a first beam portion connected to one of the at least two of the first ladder support sections and detachably and adjustably connected adjacent one end of the central beam portion; and a second beam portion connected to another one of the at least two of the first ladder support sections and detachably and adjustably connected adjacent another end of the central beam portion.

8. The device as set forth in claim 6 wherein the beam section coupled to the base structure further comprises an adjustable slant connection device that adjustably connects the beam section to the base structure.

9. The device as set forth in claim 6 wherein at least one of the at least two of the first ladder support sections are detachably and adjustable connected to the beam section.

10. The device as set forth in claim 1 wherein the brace further comprises:

an additional first brace section with one of the ladder brackets secured to the additional first brace section, the additional first brace section adjustably and detachably connected to the brace; and an additional second brace section with another one of the ladder brackets secured to the additional second brace section, the additional second brace section adjustably and detachably connected to the brace.

11. A method comprising:

providing at least one base structure comprising a brace and a plurality of detachable mounting devices connected to the brace and that detachably mount the base structure to a garage door that is positionable between a vertical orientation and a horizontal orientation; and spacing apart and securing at least two brackets to the at least one base structure, each of the brackets comprising:

at least one first support section coupled to the base structure and at least one second support section that extends from the first support section to form a hook-shaped section that defines a structure that provides a first contact surface on the first support section that directly engages with and supports sidepieces of a ladder off a ground surface when the device is positioned in the vertical orientation with respect to the ground surface by the garage door and provides a second contact surface on the second support section that directly engages with and supports the sidepieces of the ladder off the ground surface when the device is positioned in the horizontal orientation respect to the ground surface by the garage door.

12. The method as set forth in claim 11 wherein the providing the at least one base structure:

providing wing portions that extend out on opposing sides of the base structure away from the base structure, each of the wing portions further comprising at least one opening sized to mate with a securing device.

13. The method as set forth in claim 11 wherein the providing the at least one base structure further comprises:

forming at least one crease extending along at least a portion of a length of the brace.

14. The method as set forth in claim 11 wherein the providing the at least one base structure further comprises:

providing two or more of the at least one base structures, each of the two or more of the at least one base structures having the at least two spaced apart ladder brackets.

15. The method as set forth in claim 11 wherein the providing the at least one base structure further comprises:

providing a first brace portion with one of the ladder brackets secured to the first brace portion;

providing a second brace portion with another one of the ladder brackets secured to the second brace portion; and detachably and adjustably connecting a connecting brace portion to the first brace portion and the second brace portion.

16. The method as set forth in claim 11 wherein the spacing apart and securing at least two brackets to the at least one base structure further comprises:

connecting a beam section connected to the base structure;

spacing apart along and connecting at least two of the first support sections to the beam section; and connecting each of at least two of the second support sections to one of the first support sections.

17. The method as set forth in claim 16 wherein the connecting the beam section further comprises:

providing a central beam portion secured to the base structure;

connecting a first beam portion to one of the at least two of the first ladder support sections and detachably and adjustably connecting the first beam portion adjacent one end of the central beam portion; and connecting a second beam portion to another one of the at least two of the first ladder support sections and detachably and adjustably connecting adjacent another end of the central beam portion.

18. The method as set forth in claim 16 wherein the connecting the beam section further comprises connecting the beam section to the base structure with an adjustable slant connection device.

19. The method as set forth in claim 16 wherein the spacing apart along and connecting the at least two of the first ladder support sections to the beam section further comprises detachably and adjustable connecting at least one of the at least two of the first ladder support sections to the beam section.

20. The method as set forth in claim 11 wherein the providing the at least one base structure comprising the brace further comprises:

providing an additional first brace section with one of the ladder brackets secured to the additional first brace section and an additional second brace section with another one of the ladder brackets secured to the additional second brace section; and adjustably and detachably connecting the additional first brace section to one portion of the brace and the additional second brace section to another portion of the brace.

* * * * *